US010252111B2

(12) United States Patent
Burns et al.

(10) Patent No.: US 10,252,111 B2
(45) Date of Patent: Apr. 9, 2019

(54) PROTECTIVE SWIM CAP

(71) Applicants: Mako International, LLC, Plymouth, MN (US); David Burns, Edina, MN (US); Theresa Finn, Plymouth, MN (US); Kenneth Starcznski, Plymouth, MN (US); Jordan Hamilton, Eden Prairie, MN (US); Raul Fracassi, Deephaven, MN (US)

(72) Inventors: David Burns, Edina, MN (US); Theresa Finn, Plymouth, MN (US); Kenneth Starcznski, Plymouth, MN (US); Jordan Hamilton, Eden Prairie, MN (US); Raul Fracassi, Deephaven, MN (US)

(73) Assignee: Mako International, LLC, Plymouth, MN (US)

( * ) Notice: Subject to any disclaimer, the term of this patent is extended or adjusted under 35 U.S.C. 154(b) by 344 days.

(21) Appl. No.: 15/109,207

(22) PCT Filed: Dec. 30, 2014

(86) PCT No.: PCT/US2014/072788

§ 371 (c)(1),
(2) Date: Jun. 30, 2016

(87) PCT Pub. No.: WO2015/103283

PCT Pub. Date: Jul. 9, 2015

(65) Prior Publication Data

US 2016/0317871 A1 Nov. 3, 2016

Related U.S. Application Data

(60) Provisional application No. 62/045,153, filed on Sep. 3, 2014, provisional application No. 61/922,082, filed on Dec. 30, 2013.

(51) Int. Cl.

| | |
|---|---|
| ***A63B 33/00*** | (2006.01) |
| ***A42B 1/12*** | (2006.01) |
| ***A42B 1/08*** | (2006.01) |

(52) U.S. Cl.
CPC ..... *A63B 33/00* (2013.01); *A42B 1/08* (2013.01); *A42B 1/12* (2013.01)

(58) Field of Classification Search
CPC ..... A63B 33/00; A42B 1/08; A42B 1/12
See application file for complete search history.

(56) References Cited

U.S. PATENT DOCUMENTS

| | | | |
|---|---|---|---|
| 2,392,576 | A | 1/1946 | Raffaele |
| 2,581,007 | A | 1/1952 | Douglas |

(Continued)

FOREIGN PATENT DOCUMENTS

| | | | |
|---|---|---|---|
| EP | 1034710 | A1 | 9/2000 |
| WO | 1994022335 | A1 | 10/1994 |
| WO | 2012164298 | A | 8/2012 |

OTHER PUBLICATIONS

"Safety helmet with chin strap safety helmet bump cap," www.alibaba.com, retrieved from internet https://www.alibaba.com/product-detail/safety-helmet-with-chin-strap-safety_60315140018.html, Dec. 2016, 15 pp.

(Continued)

*Primary Examiner* — Richale Quinn
(74) *Attorney, Agent, or Firm* — Grumbles Law PLLC; Brittany Nanzig

(57) ABSTRACT

A protective swim cap used to protect users' heads from injuries caused by collisions. More specifically, an elastic, protective swim cap that is long enough to cover swimmers' ears and that includes a safety feature made up of alternating solid free space and open cells, wherein the safety feature is located near the center line of the protective swim cap.

24 Claims, 17 Drawing Sheets

(56) References Cited

U.S. PATENT DOCUMENTS 3,259,912 A * 7/1966 Lima ..... A42B 1/12 2/174
3,321,772 A * 5/1967 Arps ..... A42B 1/12 2/68
3,381,305 A * 5/1968 Buzzelli ..... A42B 1/12 2/68
3,447,163 A * 6/1969 Tojeiro ..... A42B 3/065 2/412
3,447,164 A * 6/1969 Greenhouse ..... A42B 1/12 2/68
3,710,393 A 1/1973 Douglas
3,755,819 A 9/1973 Douglas
3,895,152 A * 7/1975 Carlson ..... B65D 90/06 428/116
3,979,777 A * 9/1976 Gregg ..... A42B 1/12 2/68
4,134,155 A * 1/1979 Robertson ..... A42B 1/12 2/412
4,354,284 A * 10/1982 Gooding ..... A42B 3/00 2/413
4,412,358 A * 11/1983 Lavender ..... A42B 3/124 2/412
4,422,183 A * 12/1983 Landi ..... A41D 13/015 2/455
4,432,099 A * 2/1984 Grick ..... A42B 3/124 2/412
4,465,725 A * 8/1984 Riel ..... B29D 24/005 428/116
4,485,568 A * 12/1984 Landi ..... A43B 1/0009 36/103
4,912,777 A 4/1990 Gasbarro
5,056,162 A * 10/1991 Tirums ..... A42B 3/125 2/412
5,095,545 A * 3/1992 Lane ..... A42B 1/12 2/413
5,203,607 A * 4/1993 Landi ..... B62J 1/26 297/214
5,840,397 A * 11/1998 Landi ..... A41D 13/05 428/73
5,855,026 A 1/1999 Viola
5,946,734 A * 9/1999 Vogan ..... A42B 3/00 2/171
6,240,570 B1 * 6/2001 Wu ..... A42B 1/08 2/410
6,253,378 B1 * 7/2001 Nealy ..... A42B 1/12 2/68
6,389,607 B1 * 5/2002 Wood ..... A42B 3/00 2/411
6,654,960 B2 * 12/2003 Cho ..... A63B 71/1225 2/22
6,966,068 B2 * 11/2005 Johnson ..... A42B 1/12 2/200.2
7,043,761 B2 * 5/2006 Epling ..... A42B 1/069 2/181
7,058,989 B2 * 6/2006 Domingos ..... A42B 3/00 2/412
7,254,840 B2 * 8/2007 Hammons ..... A41D 19/01523 2/16
7,472,428 B2 * 1/2009 Van Atta ..... A42B 1/12 2/200.2
D599,085 S 9/2009 Booker
7,669,251 B2 * 3/2010 Hammons ..... A41D 19/01523 2/161.1
7,676,854 B2 * 3/2010 Berger ..... A42B 3/124 2/410
8,533,869 B1 * 9/2013 Capuano ..... A42B 3/12 2/171
8,713,716 B2 * 5/2014 Krueger ..... A41D 13/0002 2/412
8,915,339 B2 * 12/2014 Kanous ..... A47C 27/18 188/377
9,032,549 B1 * 5/2015 Cameron ..... A42B 1/203 2/171.3
9,131,744 B2 * 9/2015 Erb ..... A42B 3/124
9,451,795 B2 * 9/2016 Krueger ..... A42B 3/122
9,468,249 B2 * 10/2016 Fraser ..... B29C 69/00
9,814,279 B2 * 11/2017 Ho ..... A42B 3/128
2006/0070171 A1 * 4/2006 Copeland ..... A41D 31/005 2/455
2008/0141431 A1 6/2008 Rance et al.
2010/0107317 A1 * 5/2010 Wang ..... A42B 1/08 2/411
2011/0035860 A1 2/2011 Heel
2015/0157077 A1 * 6/2015 Stricker, Jr. ..... A42B 1/12 2/414

OTHER PUBLICATIONS

"Swim Helmet," www.specialneedstoys.com, retrieved from internet http://www.specialneedstoys.com/uk/independence/swimming/swim-helmet-swimming-toy.html, Dec. 2016, 4 pp.
KAP7 International, Inc.; KAP7 Head Guard; Online Retail; Nov. 29, 2014; http://www.kap7.com/kap7-head-guard/.
Steven Davis; Introducing a 'Smart Cap' for Concussion Testing; Online Article; Oct. 8, 2013; http://m.thepostgame.com/blog/futuresport/201310/introducing-smart-cap-concussion-testing.
PCT International Application Serial No. PCT/US14/11111, filed 2014.

* cited by examiner

PROTECTIVE SWIM CAP

CROSS-REFERENCE TO RELATED APPLICATIONS

This application claims the benefit of U.S. Provisional Application No. 61/922,082, filed Dec. 30, 2013, titled PROTECTIVE SWIM CAP and claims the benefit of U.S. Provisional Application No. 62/045,153, filed Sep. 3, 2014, titled PROTECTIVE SWIM CAP.

BACKGROUND OF THE INVENTION

Sports-related head injuries and concussions have become increasingly common. The frequency of injuries is growing each year while public tolerance is shrinking. These injuries vary in complexity with each sport, and there is a need to minimize or eliminate these injuries altogether.

Head injuries are common in swimming pools. Swimmers obtain head injuries by hitting their head on a rigid pool surface, such as the walls, or by running into other swimmers as they learn to swim, train to swim faster, and compete on a regular basis. Whether or not these injuries result in long-term negative physical effects or are shaken off, swimmers are repeatedly at risk of head injuries or concussions when they have impacts with the wall or other swimmers.

Current swim caps are round, do not mimic the shape of the human head, wrinkle when they are worn, and do not cover a swimmer's ears. All of these features increase drag and swim times for competitive swimmers. Additionally, swimmers frequently have to wear two caps: a regular silicone cap and a racing cap to cover the wrinkles in the silicone cap.

A swim cap is needed that fits like a traditional latex or silicone swim cap, but that protects swimmers from head injuries due to impact with a wall or other swimmers.

SUMMARY OF THE INVENTION

The protective swim cap disclosed herein is a product that swimmers can use to protect their head from injuries caused by collision with pool walls or other swimmers. More specifically, the protective swim cap is made from an elastic material, has a safety feature, and is long enough to cover a swimmer's ears. With knowledge of the safety feature, a swimmer has less need to worry about head trauma and can, therefore, focus on swimming faster as they approach walls for turns and finishes.

DETAILED DESCRIPTION

Figure 1:
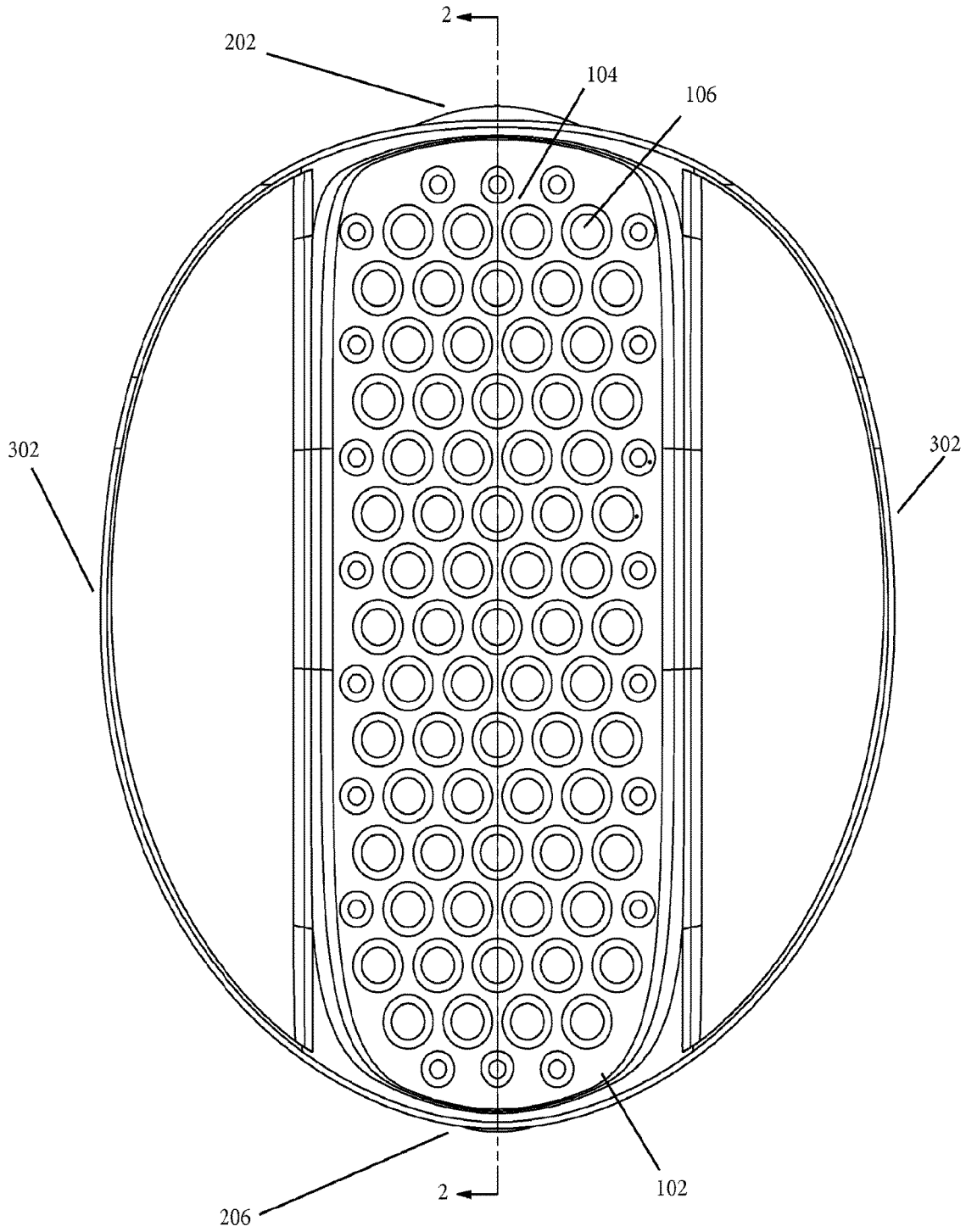
FIG. 1 is a bottom cross-sectional view of one version of a protective swim cap with a safety feature.

The present disclosure relates to a protective swim cap that reduces the likelihood of head injuries when worn in a swimming pool. Various embodiments of the protective swim cap will be described in detail with reference to the drawings, wherein like reference numerals represent like parts and assemblies throughout the several views. Reference to various embodiments does not limit the scope of the protective swim cap disclosed herein. Additionally, any examples set forth are not intended to be limiting and merely set forth some of the many possible embodiments for the protective swim cap. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

In some embodiments, the protective swim cap is made from an elastic material that reforms its original shape after being stretched with varying degrees of tensile and elongation in a material such as, but not limited to, silicone, silicone composition, latex or other materials with similar properties to achieve desired results. The protective swim cap, in preferred embodiments, has a safety feature 102 that can provide a cushioning effect in the case of contact with a hard object or surface or other swimmer to protect the head of a swimmer. With knowledge of the safety feature 102, a swimmer can minimize worry about head trauma and, therefore, try harder to swim faster into the walls for turns. In some embodiments, the protective swim cap can have a safety feature 102 and be of an overall uniform thickness. In other embodiments, the protective swim cap can have a safety feature 102 and be of varying thicknesses in different areas. For example, the front 202, top 204, and back 206 may all be thicker than the sides 302. Alternatively, in some embodiments, only the front 202, top 204, back 206, or some combination of the three may be thicker than the rest of the protective swim cap. In other embodiments, the protective swim cap may be thicker along the bottom edge 602 of the protective swim cap than it is at other locations on the protective swim cap, as illustrated in FIGS. 6, 10, 14, and 19.

Figure 2:
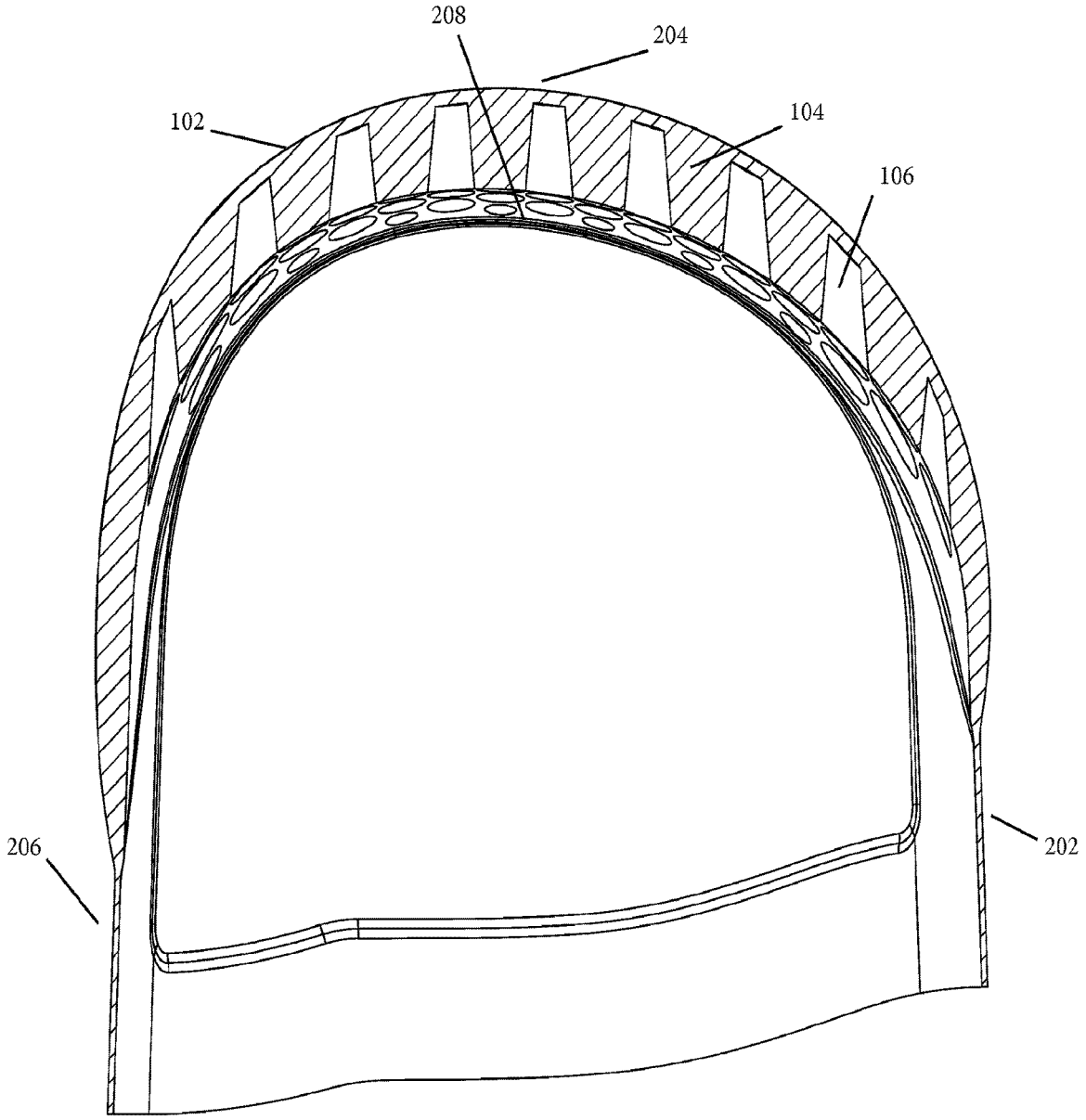
FIG. 2 is a right side cross-sectional view of the protective swim cap of FIG. 1.
Figure 4:
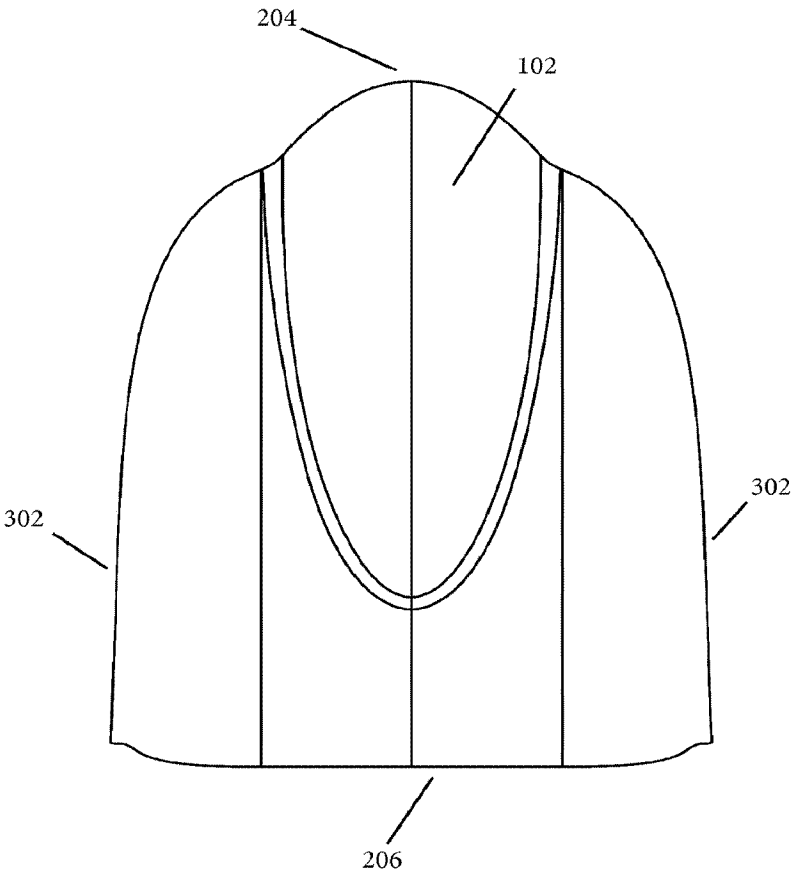
FIG. 4 is rear view of the protective swim cap of FIG. 1.
Figure 3:
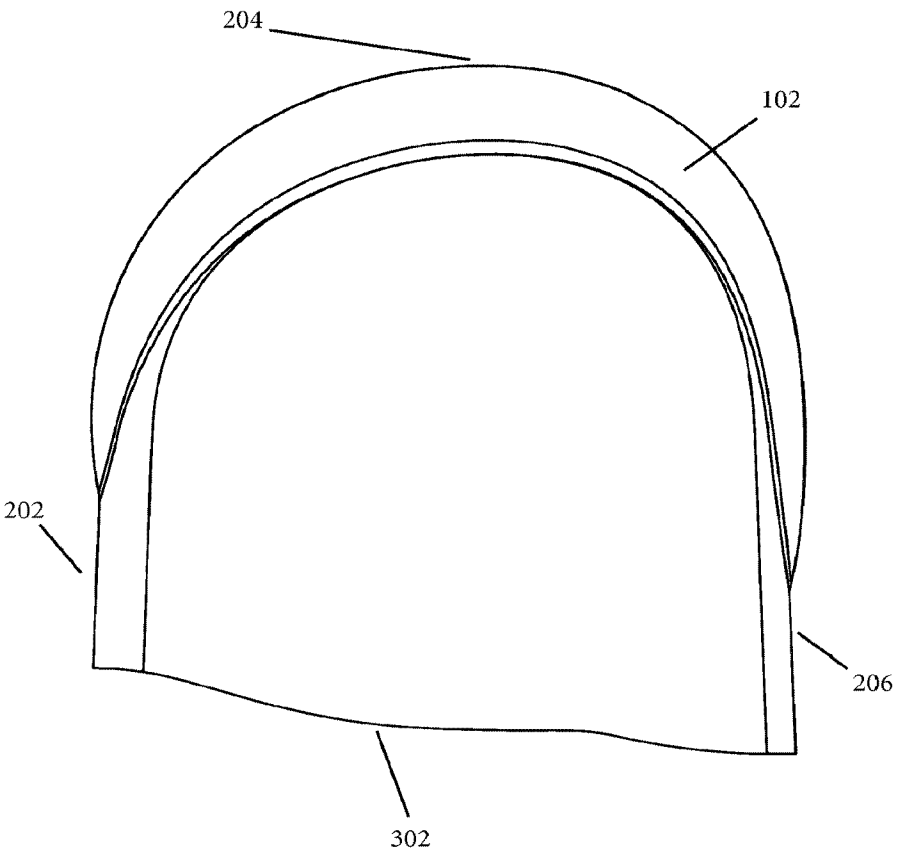
FIG. 3 is a left side view of the protective swim cap of FIG. 1.
Figure 5:
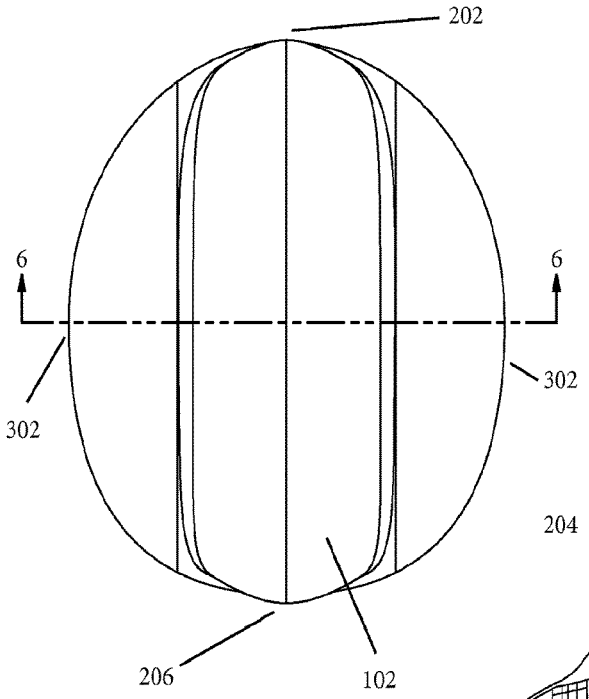
FIG. 5 is a top view of the protective swim cap of FIG. 1.
Figure 6:
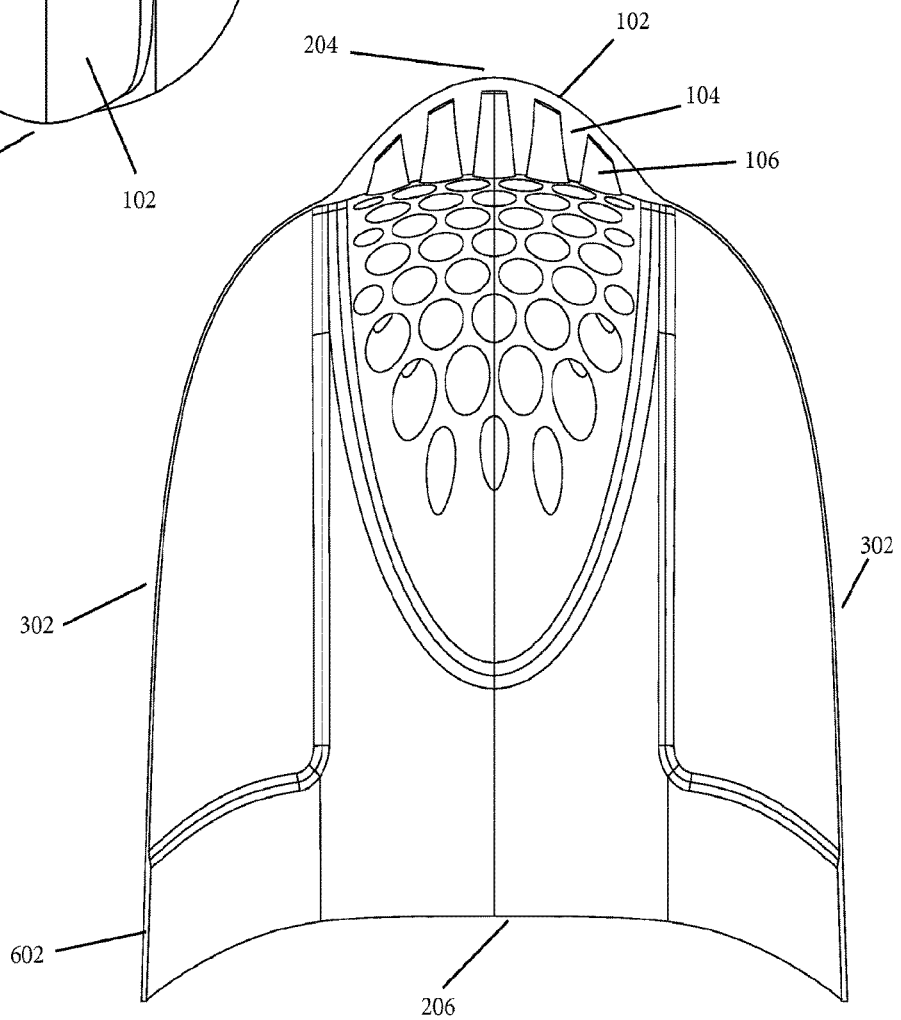
FIG. 6 is a front cross-sectional view of the protective swim cap of FIG. 1.
Figure 10:
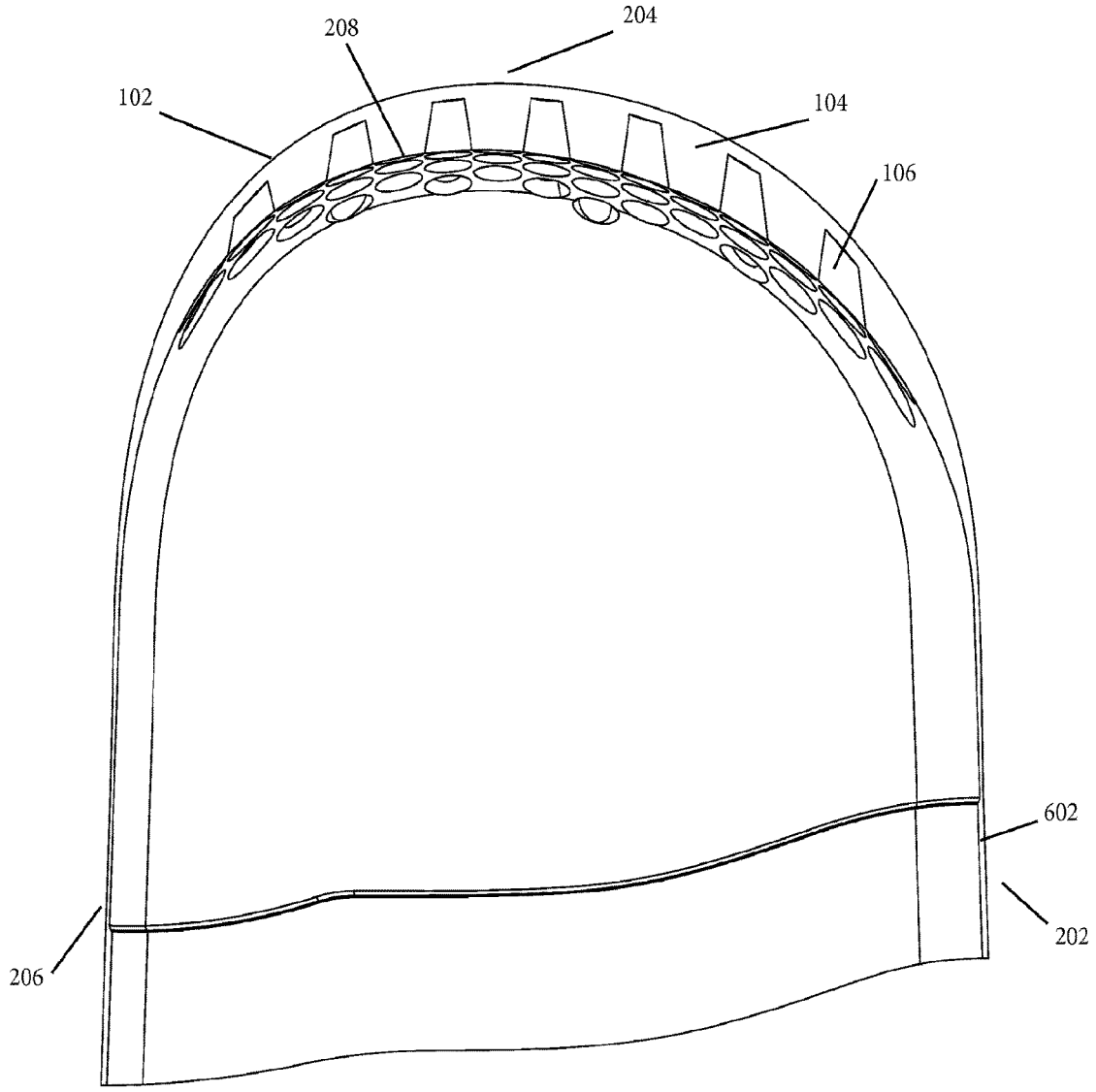
FIG. 10 is a right side cross-sectional view of the protective swim cap of FIG. 9.
Figure 12:
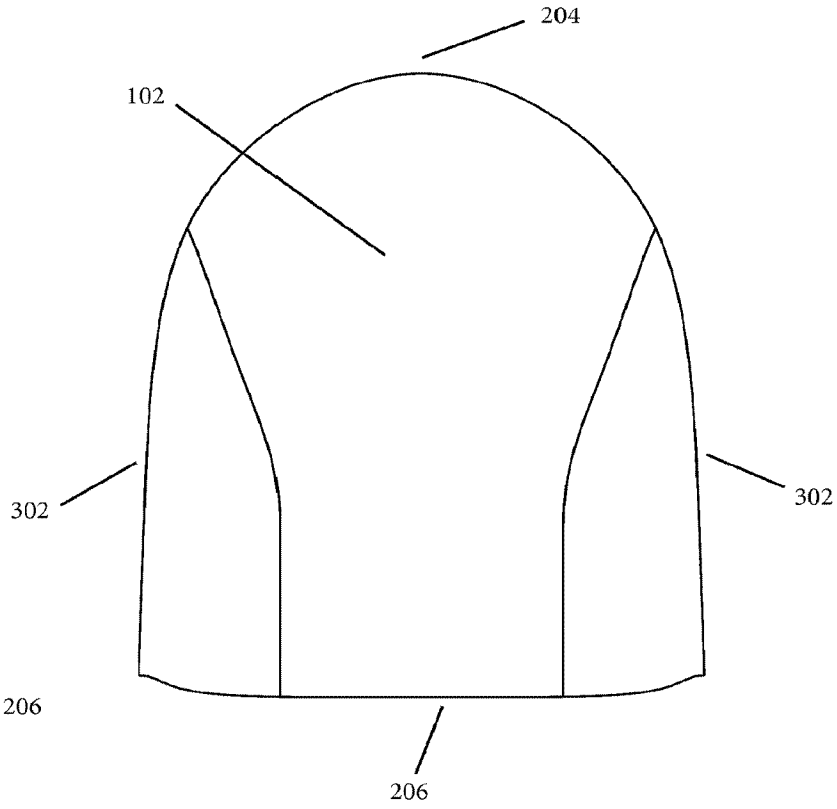
FIG. 12 is a rear view of the protective swim cap of FIG. 9.
Figure 11:
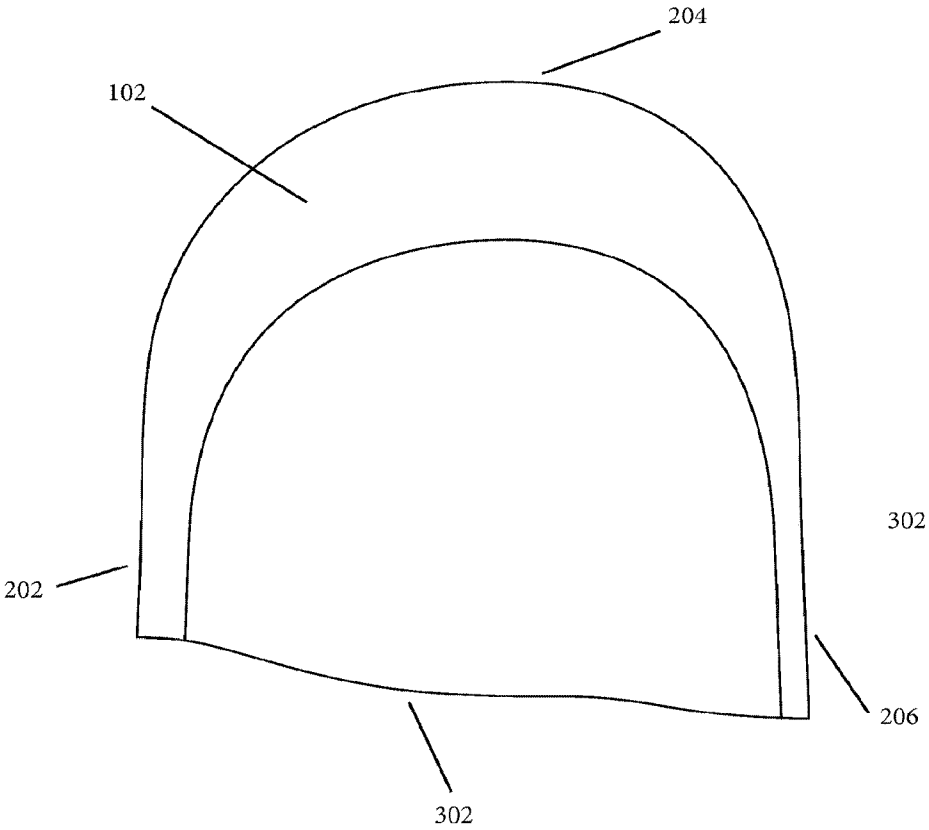
FIG. 11 is a left side view of the protective swim cap of FIG. 9.
Figure 13:
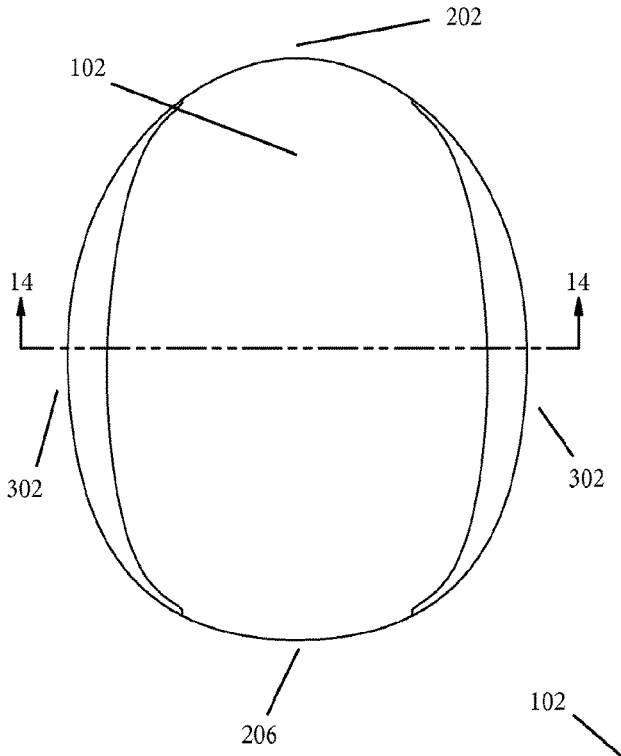
FIG. 13 is a top view of the protective swim cap of FIG. 9.
Figure 14:
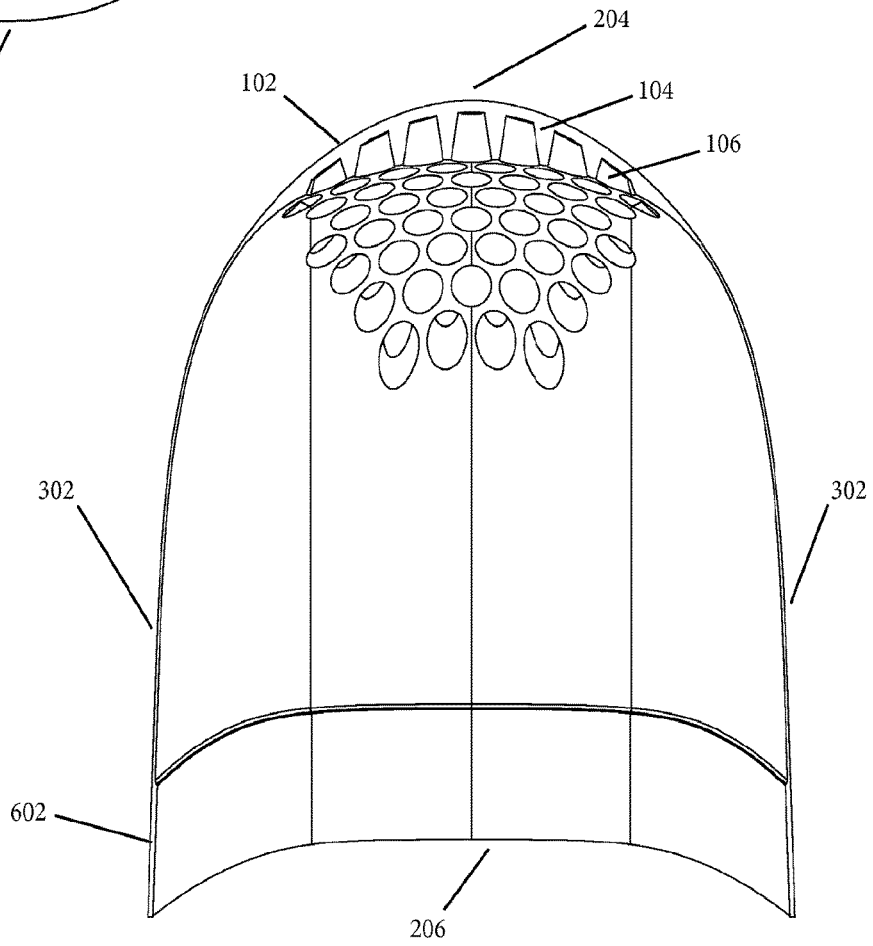
FIG. 14 is a front cross-sectional view of the protective swim cap of FIG. 9.
Figure 16:
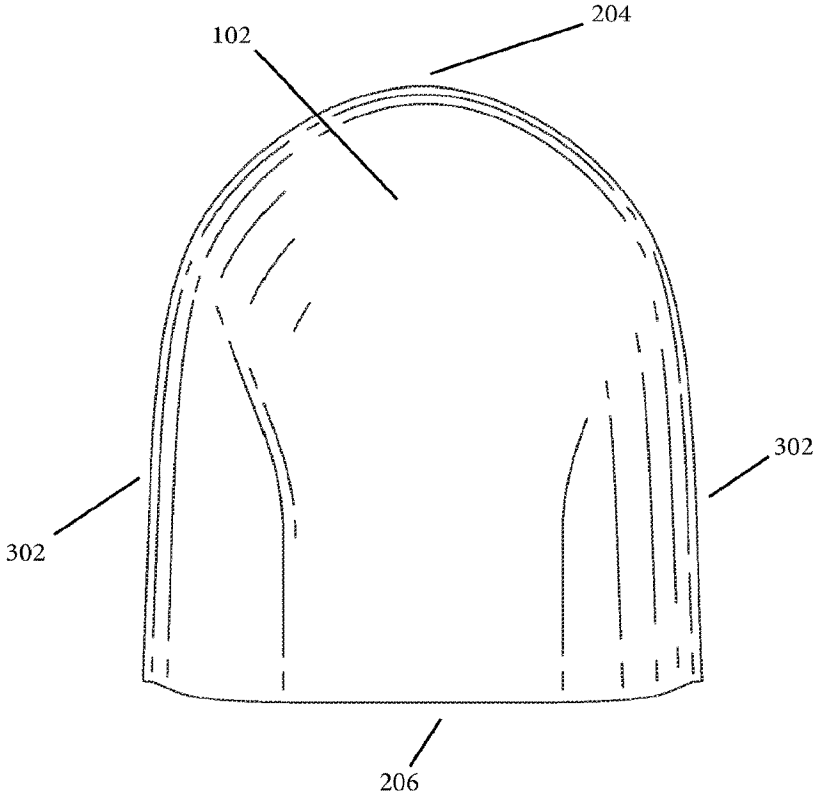
FIG. 16 is a back view of the protective swim cap of FIG. 9.
Figure 15:
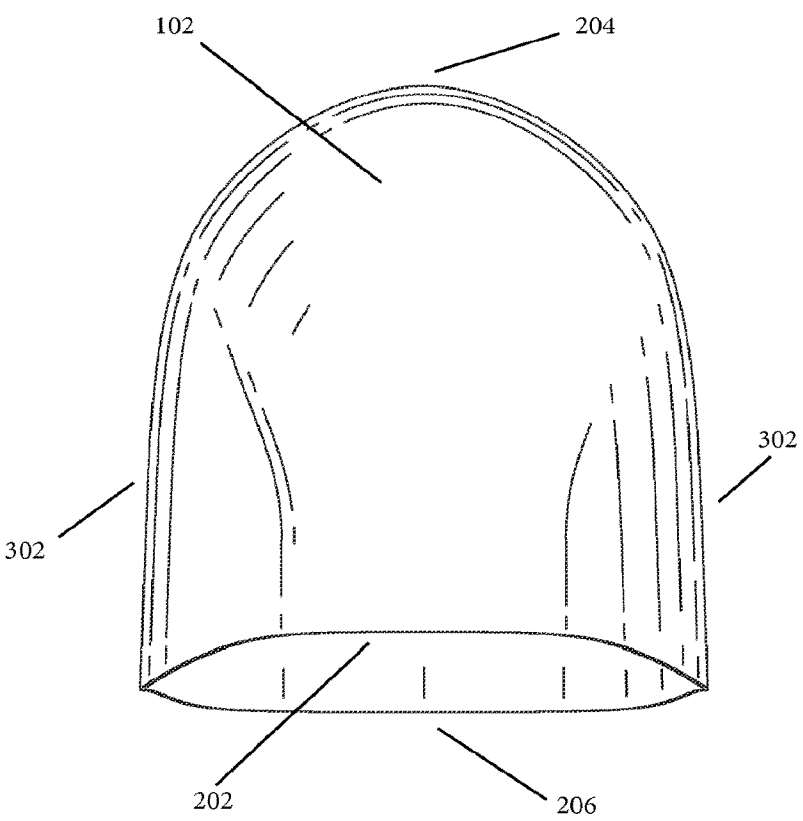
FIG. 15 is a front view of the protective swim cap of FIG. 9.
Figure 18:
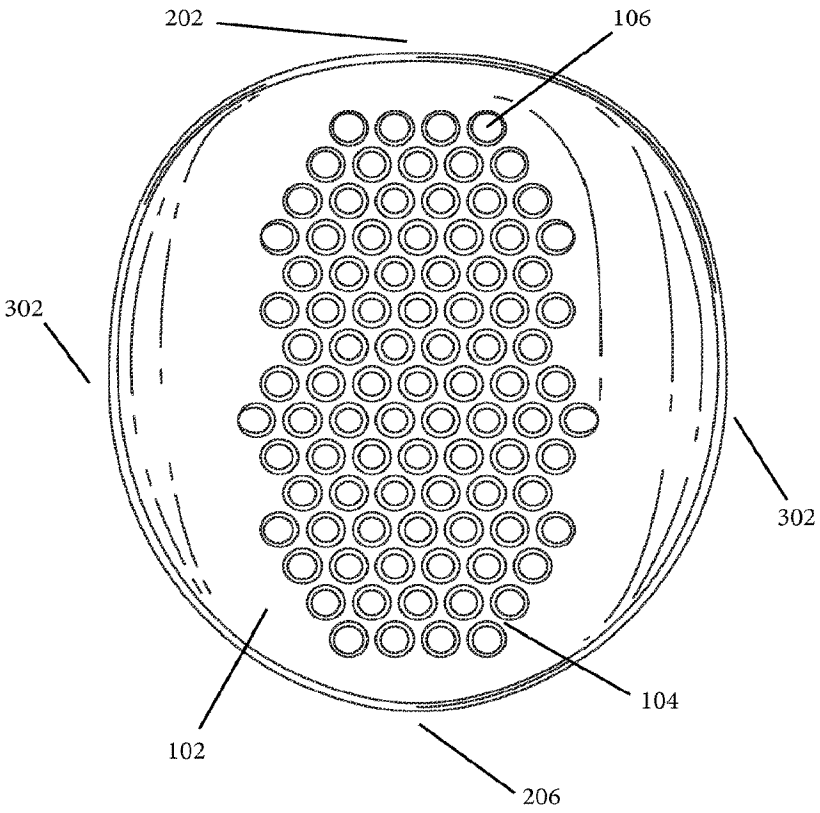
FIG. 18 is a bottom view of the protective swim cap of FIG. 9.
Figure 17:
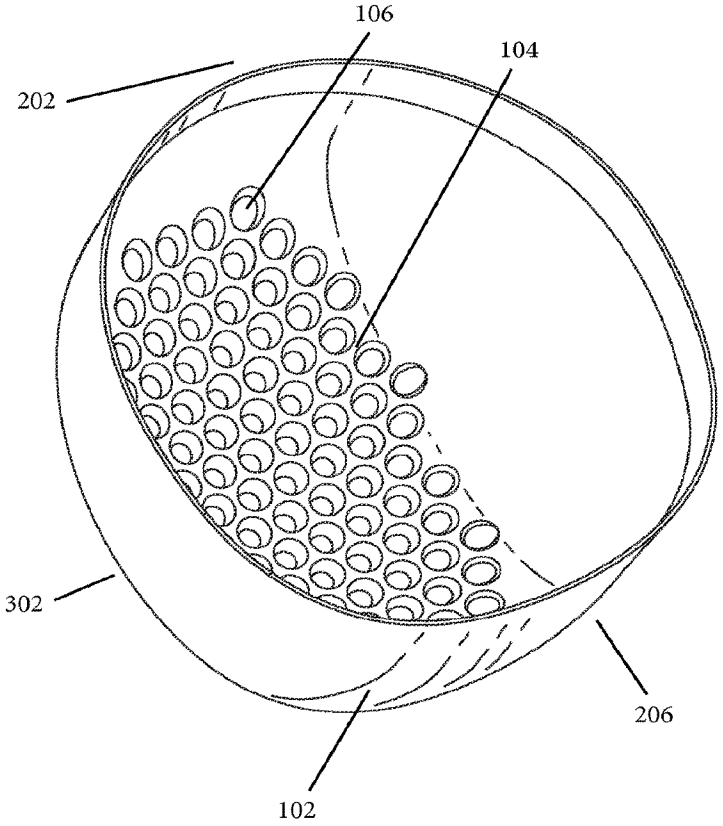
FIG. 17 is a bottom perspective view of the protective swim cap of FIG. 9.
Figure 19:
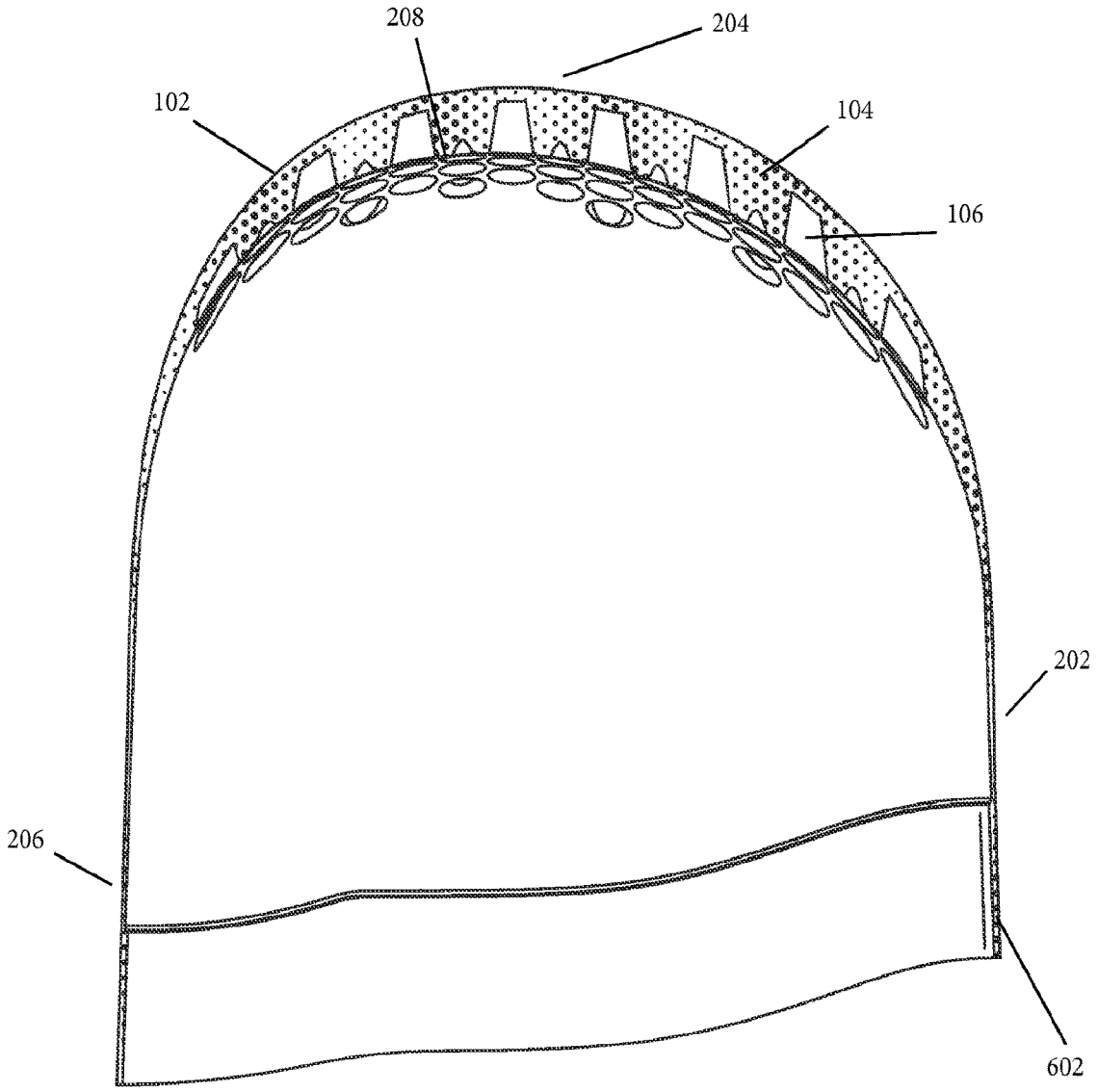
FIG. 19 is a cross-sectional right side view of the protective swim cap of FIG. 9.
Figure 21:
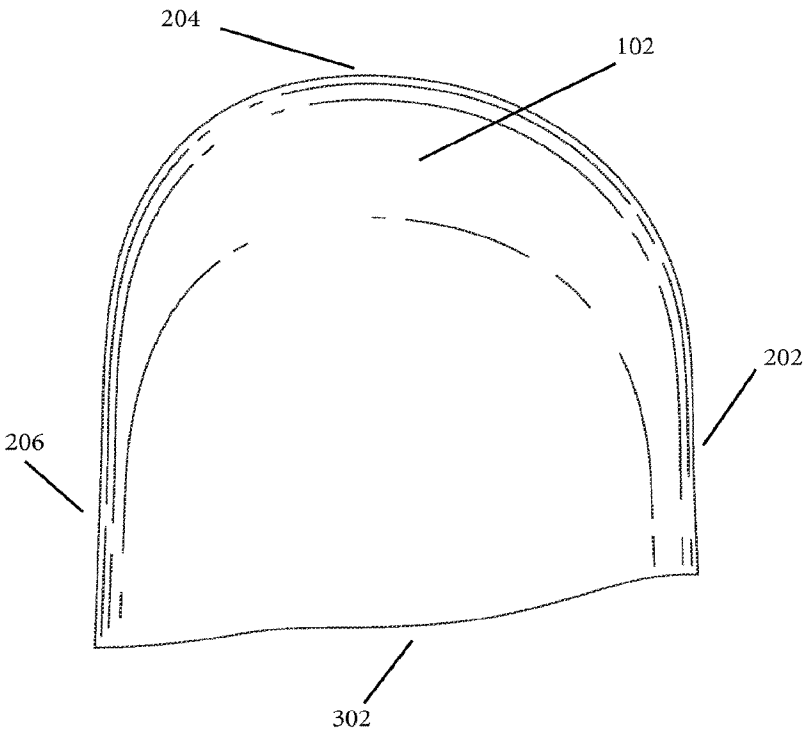
FIG. 21 is a right side view of the protective swim cap of FIG. 9.
Figure 20:
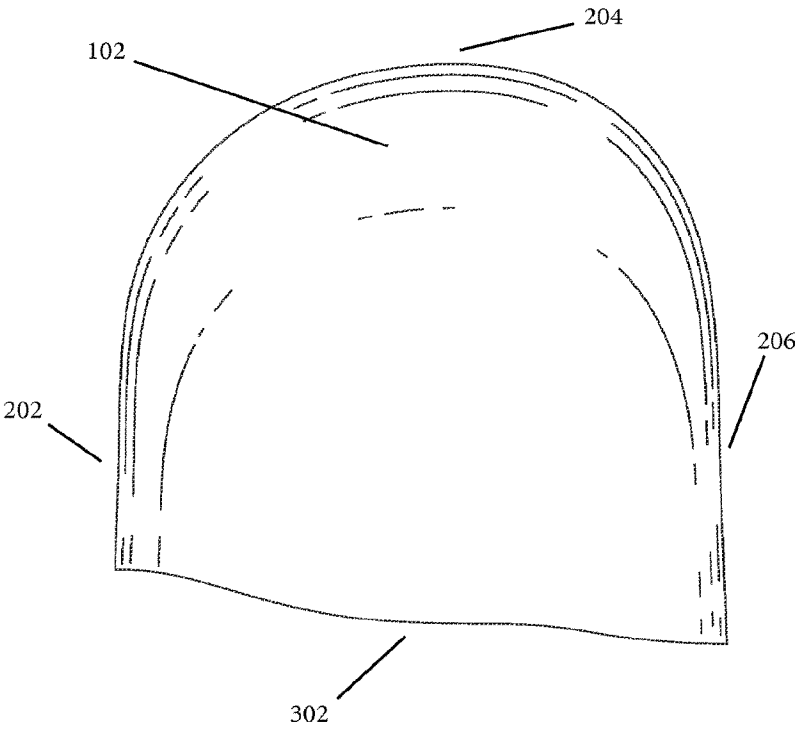
FIG. 20 is a left side view of the protective swim cap of FIG. 9.
Figure 23:
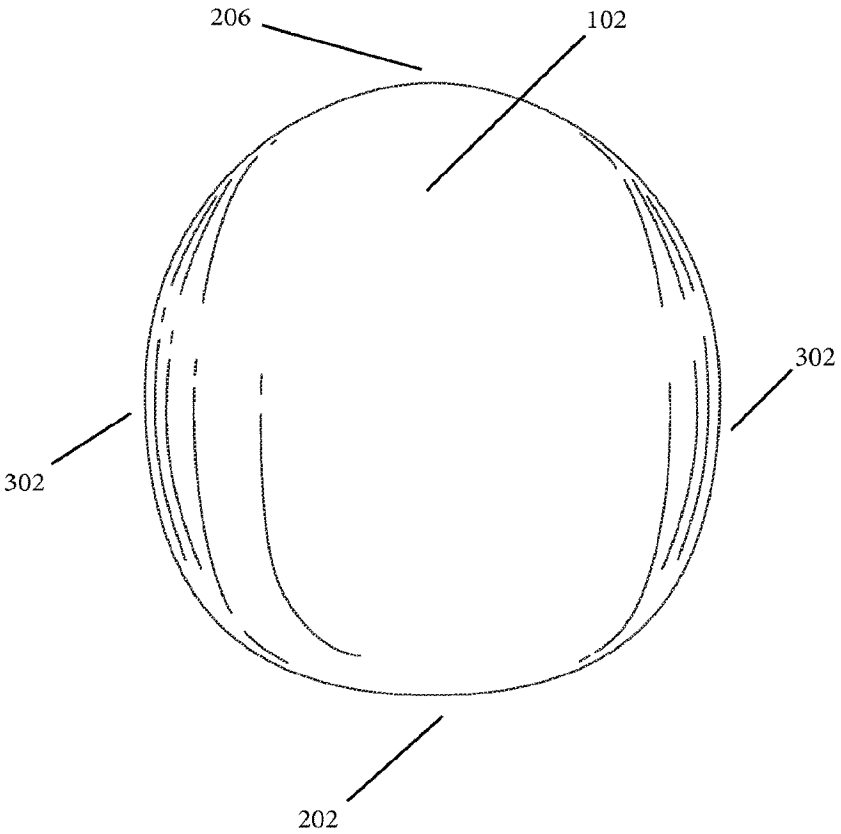
FIG. 23 is a top view of the protective swim cap of FIG. 9.
Figure 22:
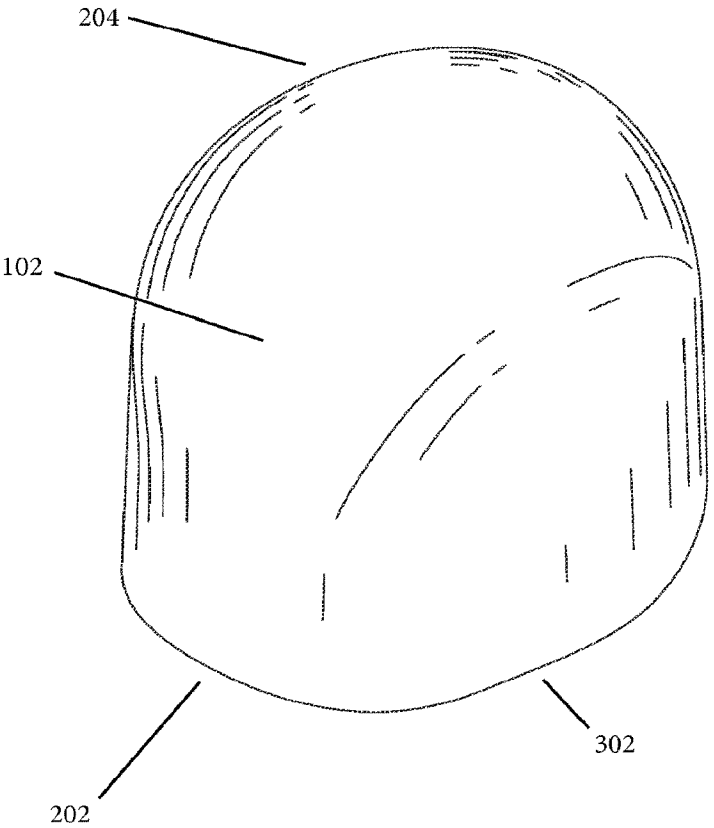
FIG. 22 is a perspective side view of the protective swim cap of FIG. 9.
Figure 25:
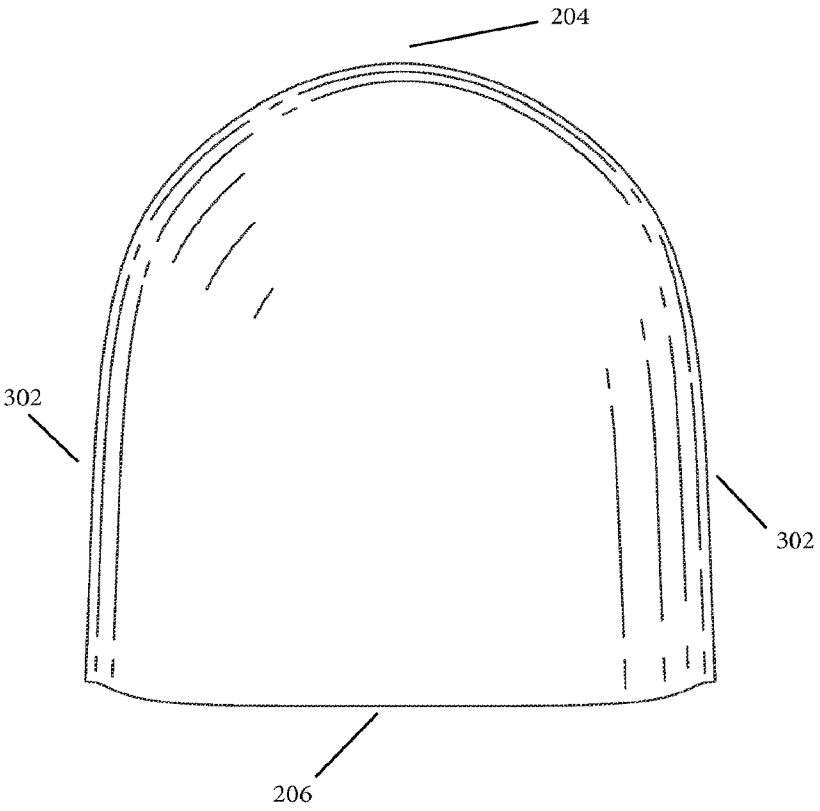
FIG. 25 is a back view of the protective swim cap of FIG. 24.
Figure 24:
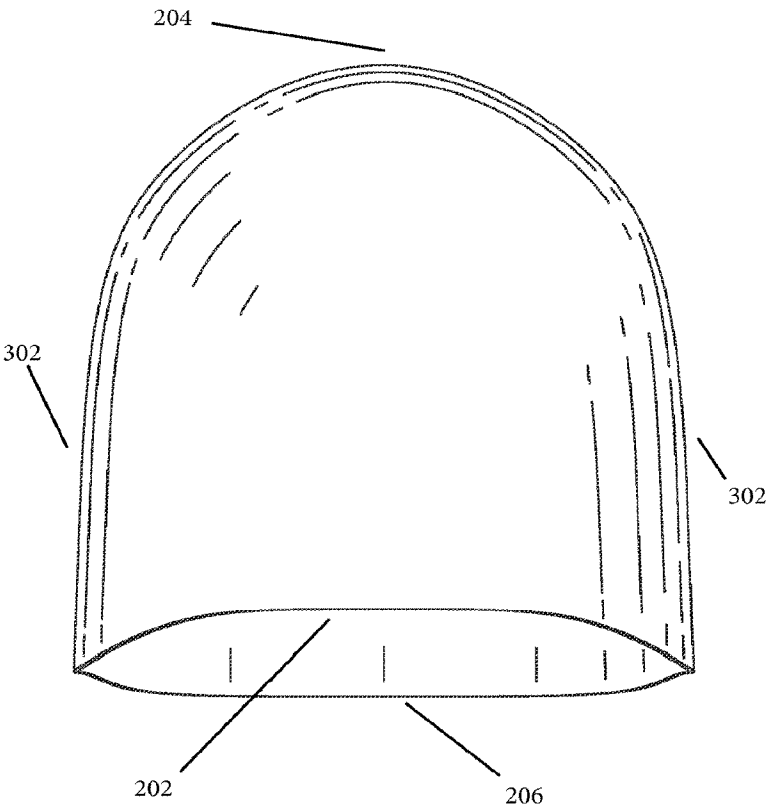
FIG. 24 is a front view of one version of a protective swim cap without a safety feature.
Figure 27:
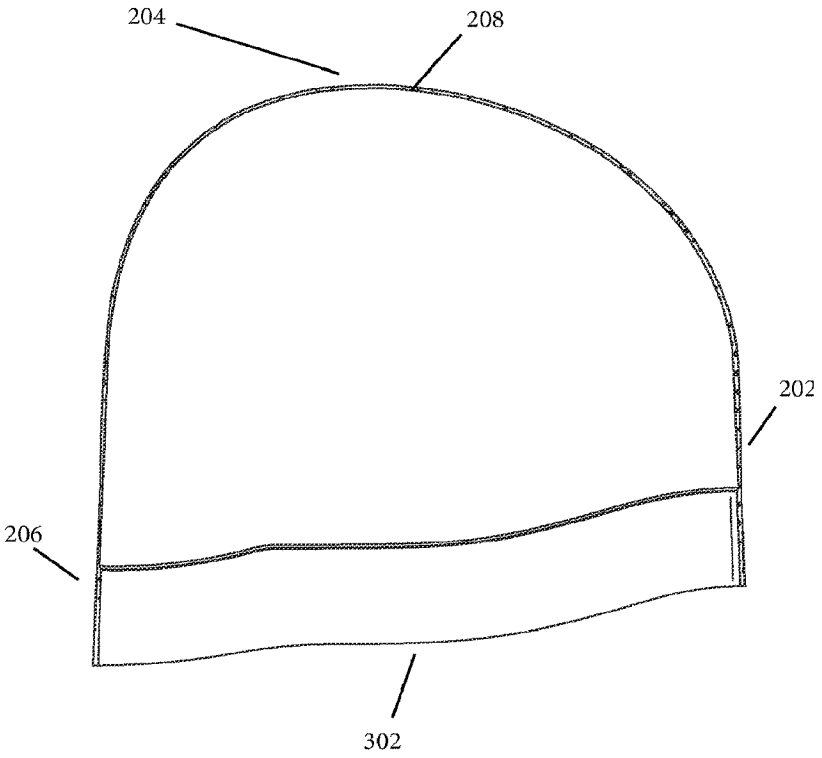
FIG. 27 is a cross-sectional right side view of the protective swim cap of FIG. 24.
Figure 26:
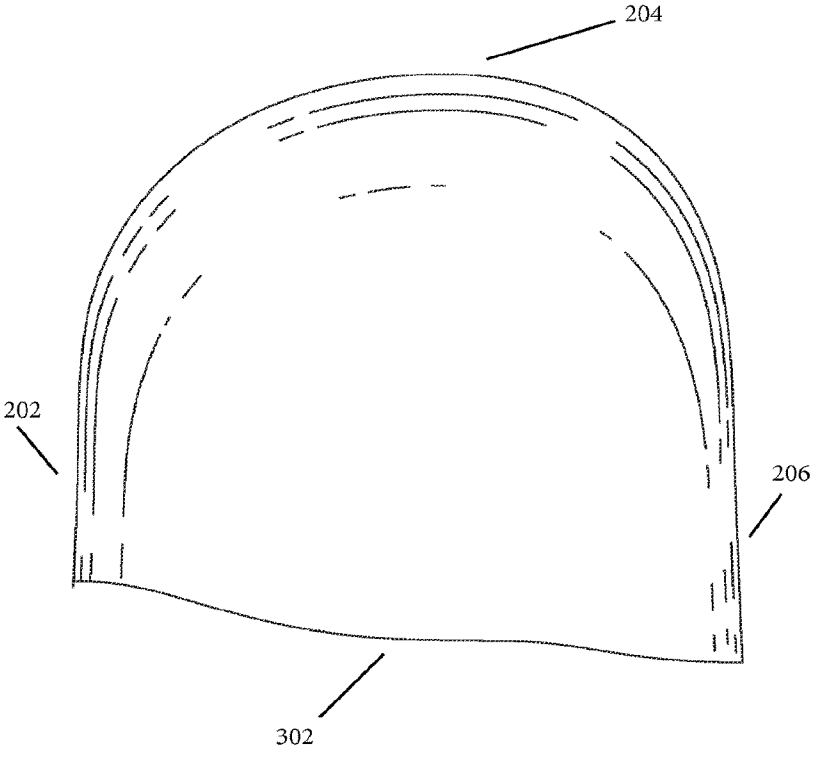
FIG. 26 is a left side view of the protective swim cap of FIG. 24.
Figure 29:
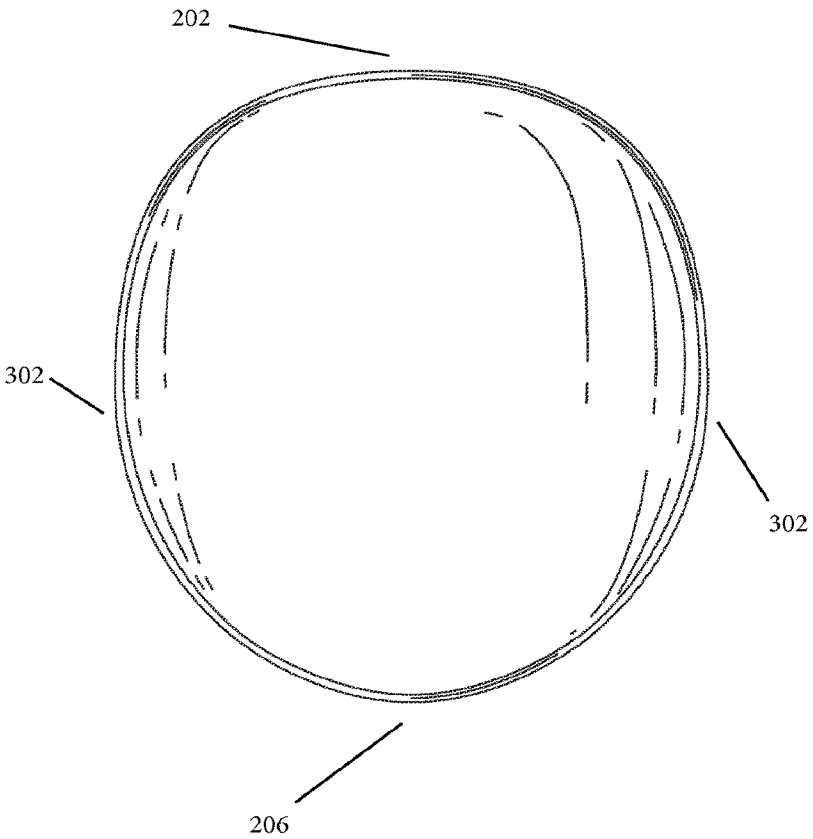
FIG. 29 is a bottom view of the protective swim cap of FIG. 24.
Figure 28:
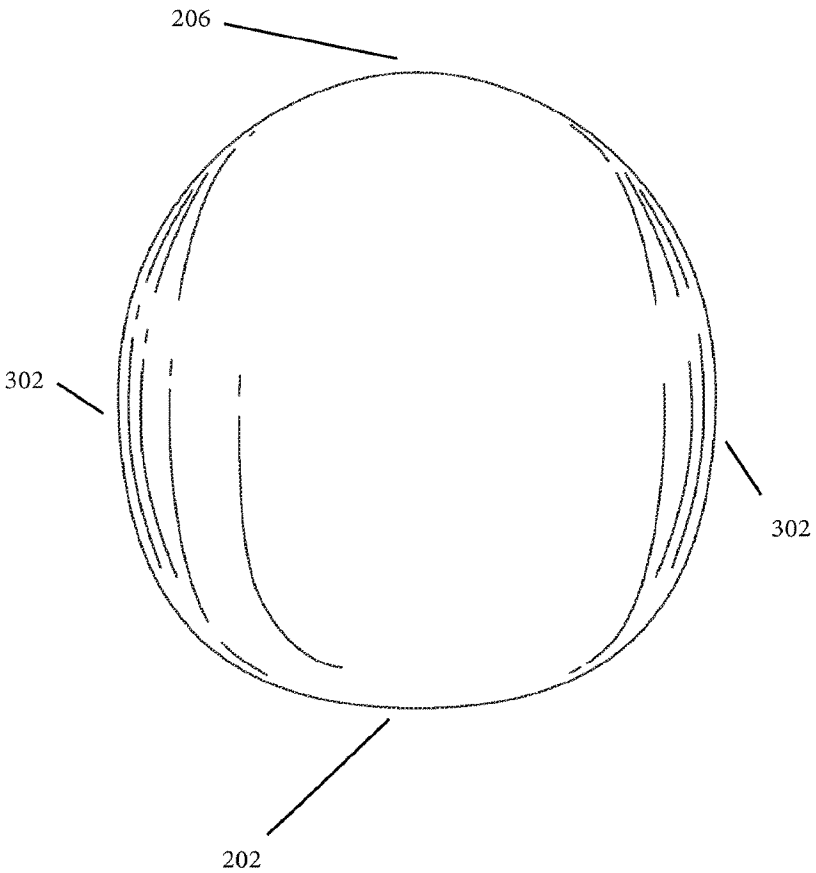
FIG. 28 is a top view of the protective swim cap of FIG. 24.

The safety feature 102 can generally be located above the protective swim cap's underside 208, which is smooth and flat and intended to be in contact with the swimmer's head, as illustrated in FIGS. 2, 10, and 19. The safety feature 102 can also have a specified width at the crown of the protective swim cap and a specified rise. In one embodiment, the rise is greater in the center of the protective swim cap and decreases as it expands out onto the sides 302 of the protective swim cap, as illustrated in FIGS. 4, 6, and 14.

In some embodiments, the safety feature 102 is a permanent feature of the protective swim cap. In other embodiments, the safety feature 102 is removable from the protective swim cap to enable a user to vary the amount of protection the user has. For example, if a user is swimming and wants to practice diving, the user can remove a safety feature 102 with less protection and replace it with a safety feature 102 that offers more protection. If removable, the safety feature 102 can be connected to the protective swim cap via a pocket. For example, the inside of the protective swim cap can have an opening to a pocket, whereby the safety feature 102 can be slid into the pocket. Alternatively, the safety feature 102 can be attached to the inside or the outside of the protective swim cap through an adhesive, hook and loop, or other releasable or connector/attachment means. In other embodiments, the protective swim cap does not have any safety feature 102, but maintains the size, fit, length, and thickness of the various embodiments of the protective swim cap described herein that contain the safety feature 102.

In some embodiments, the safety feature 102 can be made up of alternating, and repeated, solid free space 104 and open cells 106, as illustrated in FIGS. 1, 2, 6, 9, 10, 14, and 17-19. In some embodiments, the alternating solid free space 104 and open cells 106 are in a honeycomb pillar structure. However, the honeycomb pillar structure is not required for the safety feature 102 to be effective. Therefore, other geometrical patterns such as, but not limited to, lines of open cells 106, alternating open cells 106, circles or arcs of open cells 106, or other repeating or non-repeating patterns, can be implemented using the solid free space 104 and open cells 106. In some embodiments, the open cells 106 of the safety feature 102 are open to the air on the inside of the protective swim cap. In other embodiments, the open cells 106 are covered and sealed to prevent water from getting into the open cells 106 when the protective swim cap is underwater.

The solid free space 104 of the safety feature 102 can be made of solid silicone, silicone composition, latex, or other materials with similar properties to achieve desired results. The open cells 106 of the safety feature 102 can be a variety of three-dimensional shapes such as, but not limited to, hexagons, columns, cylinders, cones, or spheres. Further, the open cells 106 can vary in size for different safety needs. For example, triathlon open water swimmers, training divers, or other individuals participating in extreme events may need more protection and, thus, deeper open cells 106. In some embodiments, the safety feature 102 can be about 0.50 to 0.75 inches tall and the individual open cells 106 can vary in diameter from about 0.125 to 0.375 inches, wherein some of the open cells 106 have an outer diameter of about 0.25 inches and in an inner diameter of about 0.125 inches and some of the open cells 106 have an outer diameter of about 0.375 inches and an inner diameter of about 0.25 inches. In some embodiments, the safety feature 102 can have a solid layer between the open cells 106 and the surface of the protective swim cap that is about 0.10 inches in depth.

In some embodiments, and the variation in size can be based on the location of the open cells 106 on the protective swim cap. For example, in one embodiment, the open cells 106 can vary in depth and the deepest open cells 106 can be located at the very top 204 of the dome of the protective swim cap. As the rounded contour of the protective swim cap fades into the smooth sides 302, the open cells 106 can get shallower, as illustrated in FIGS. 6 and 14. Similarly the open cells 106 can vary in width or diameter, as illustrated in FIGS. 1 and 6, wherein open cells 106 that have a narrower diameter offer more protection than open cells 106 that have a broader diameter. Therefore, in one embodiment, the narrowest open cells 106 can be located at the very top 204 of the dome of the protective swim cap and the wider open cells 106 can be located on the sides 302 of the protective swim cap, or vice versa. In another embodiment, each open cell 106 may be a specified diameter at the top 204 of the protective swim cap and may taper down in diameter at the outer surface of the safety feature 102 of the protective swim cap, as illustrated in FIGS. 1 and 6.

The safety feature 102 can begin around a swimmer's hairline in front and proceed from the front of the head to the back of the skull, as illustrated in FIGS. 1-10, 14, and 17-19. Further, the safety feature 102 can be any number of widths, thereby offering various amounts of protection to a swimmer. Therefore, open cells 106 that run down the front-to-back center, or near-center, line of the protective swim cap may be narrower or deeper than open cells 106 that run down the front-to-back lines on the sides 302 of the protective swim cap. In another embodiment, open cells 106 along the side-to-side midline, or near-midline, of the protective swim cap may be narrower or deeper than open cells 106 that are located at the front 202 or back 206 of the protective swim cap, as illustrated in FIG. 10, where the open cells 106 near the midline are deeper than those in the back 206, and in FIG. 19, where the open cells 106 near the midline are deeper than those in both the front 202 and the back 206. In a further embodiment, open cells 106 along the side-to-side midline, or near-midline, of the protective swim cap may be the same depth or width as open cells 106 that are located at the front 202 or back 206 of the protective swim cap, as illustrated in FIG. 10, where the open cells 106 in the front 202 are the same depth as those near the midline. In preferred embodiments, the protective swim cap will not have open cells 106 in certain areas, such as the embodiments illustrated in FIGS. 1, 2, 6, 9, 10, 14, and 17-19. In some embodiments, the protective swim cap will not have any open cells 106, as illustrated in FIGS. 24-29.

Additionally, the locations of the open cells 106 of the safety feature 102 can vary in respect to distance from one another. In some embodiments, the open cells 106 can be evenly spaced throughout the protective swim cap or the region of the protective swim cap intended to contain open cells 106. The open cells 106 can be very close together, at a moderate distance from each other, or more spread apart, depending on the safety needs of the swimmer, with open cells 106 that are spaced closer together offering greater protection upon impact. In other embodiments, the spacing of the open cells 106 can vary depending on the region of the protective swim cap. For example, the open cells 106 may be closer together at the top 204 and front 202 of the protective swim cap, but further apart on the back 206 and sides 302 of the protective swim cap. Alternatively, the back 206 of the protective swim cap, in addition to the front 202 and top 204, could also have open cells 106 spaced close together. In another embodiment, the open cells 106 may be closer together at the back 206 and top 204 of the protective swim cap, but further apart on the front 202 and sides 302 of the protective swim cap.

Overall, varying of cell spacing, cell diameter, open cell thickness, and silicone, silicone composition, latex, or other composition of the safety feature 102 can affect resilience and impact absorption properties of the safety feature 102 of the protective swim cap. For example, a diver may want maximum protection in case the diver hits his or her head on the diving board. For this type of situation, a protective swim cap safety feature 102 would be preferred that covers the entire protective swim cap and has open cells 106 that are uniformly deep, narrower in diameter, and very close together. In another example, a swimmer who swims the front crawl and back crawl would use a protective swim cap with a safety feature 102 comprising open cells 106 on the top 204, front 202, and back 206 that are deeper, narrower, and closer together compared to the open cells 106 on the sides 302.

Figure 8:
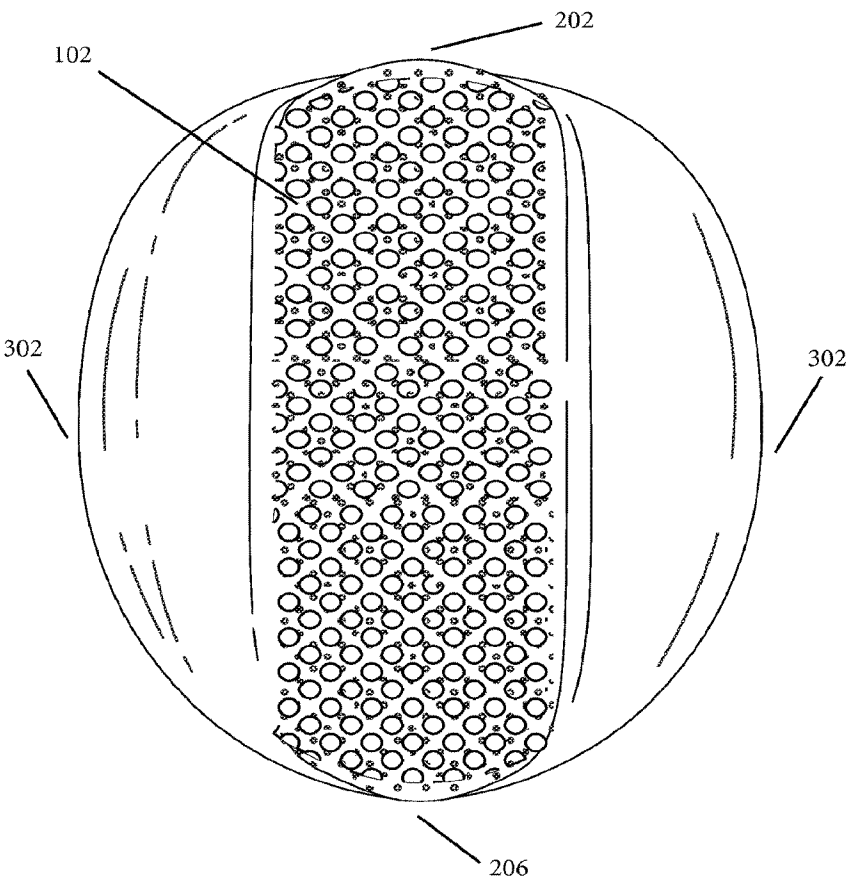
FIG. 8 is a top view of the protective swim cap of FIG. 7.
Figure 7:
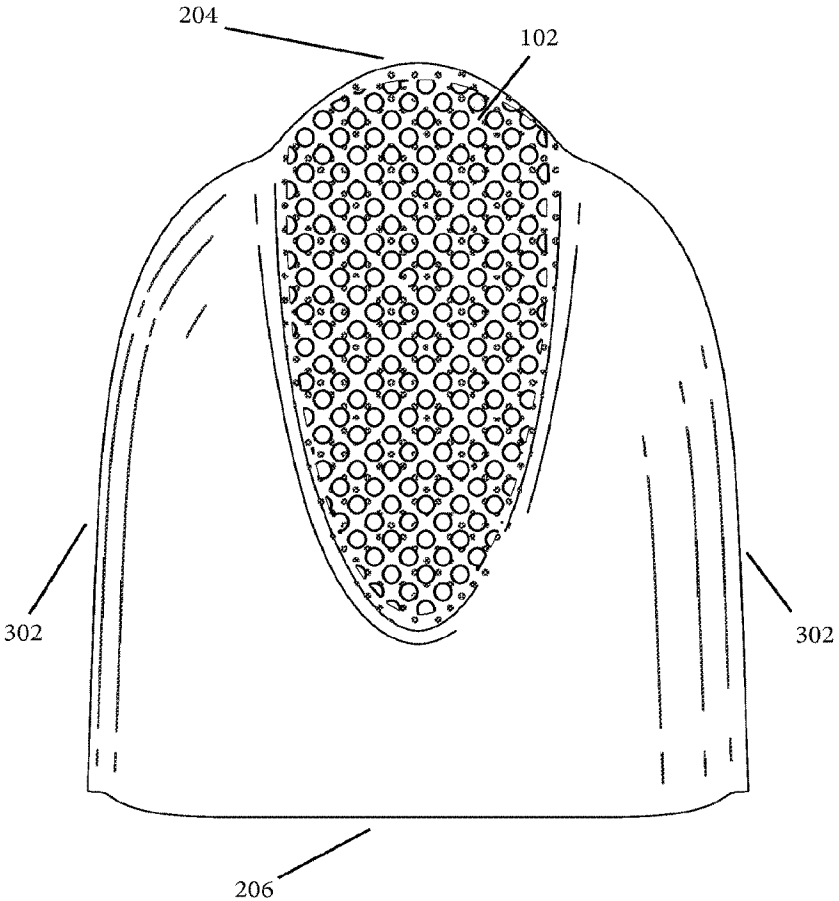
FIG. 7 is a back view of a one version of a protective swim cap with a dimpled safety feature.
Figure 9:
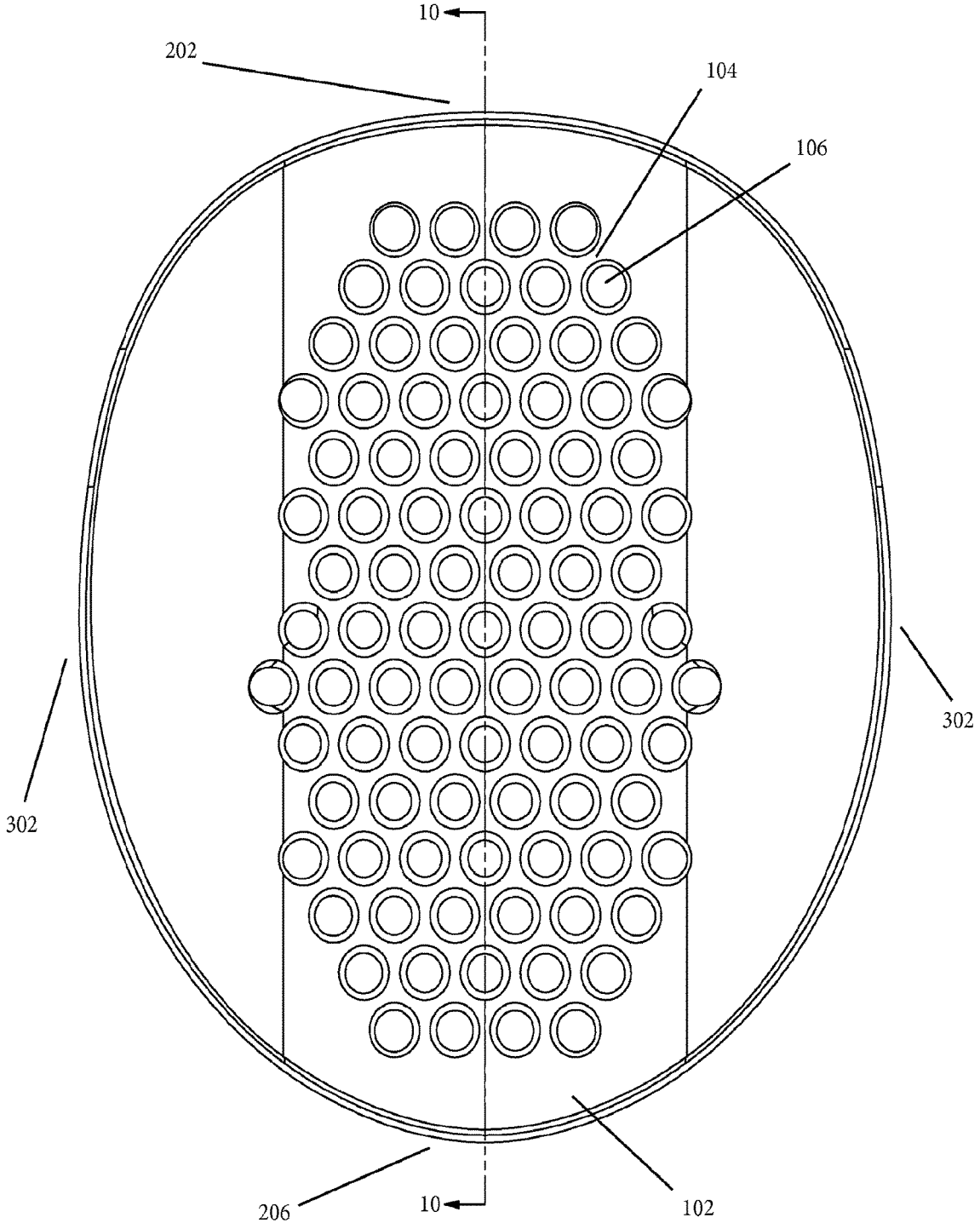
FIG. 9 is a bottom cross-sectional view of one version of a protective swim cap with a safety feature.

In one embodiment, the outer surface of the safety feature 102 may be smooth, as illustrated in FIGS. 3-5, 11-13, 15, 16, and 20-29. In another embodiment, the outer surface of the safety feature 102 may have a convex, dimpled texture for a hydrodynamic benefit, as illustrated in FIGS. 7 and 8. In some embodiments, the surface can be a random pebbled or course sandpaper style finish on the top 204 of the protective swim cap. The non-smooth surface can fade to a smooth finish on the sides 302 and back 206 of the protective swim cap, which allows for design imprinting on the protective swim cap. While the non-smooth surface at or near the leading edge of the protective swim cap (i.e., the front 202 and top 204 of the protective swim cap) decreases laminar flow by breaking up the flow, reduces turbulence and drag over the protective swim cap and, therefore, increases the speed of water flowing over the surface of the protective swim cap, the location of the rough surface can be anywhere, or everywhere, on the protective swim cap. However, while convexities on the sides 302 and the back 206 of the protective swim cap are possible, they will likely produce drag and turbulence due to the trailing edge area. Therefore, the preferred embodiment has convexities at only the front 202 and top 204 of the protective swim cap, while the remainder of the protective swim cap is smooth. In some embodiments, the texture of the non-smooth surface can be uniform or random so as to disrupt laminar flow. In some embodiments, the non-smooth area can be around, or less than, 1 min tall. By addressing this water/cap boundary layer, the water streamlines over the protective swim cap and swimmer, thus allowing the swimmer to swim faster. Faster speeds can also be obtained because, in one embodiment, the protective swim cap can eliminate material wrinkling, which creates drag for swimmers.

The protective swim cap can be shaped to accommodate the safety feature 102 and the shape of the swimmer's head. It can also cover the swimmer's ears. Generally, instead of having a round shape, the protective swim cap can have the anatomical shape of a human head. This design results in a better, tighter fit when worn. In this embodiment, the protective swim cap automatically covers the entirety of a swimmer's ears. The swimmer does not have to repeatedly pull the protective swim cap down over his or her ears and does not have to worry about the protective swim cap only covering a portion of the swimmer's ears, unlike round caps. In addition to the general shape, the protective swim cap is tapered to fit the head, as illustrated in FIGS. 1, 5, 8, 9, 13 18, 23, and 29. These features work together to create a better fit on a swimmer's head, greater comfort for the swimmer, and no wrinkles when worn, which results in less drag in the water. By keeping the ears covered, the user can reduce the chance of getting ear infections and can reduce drag caused by water flowing in, out, and around the ear. In some embodiments, the front 202 of the protective swim cap is shorter than the back 206 of the protective swim cap, as illustrated in FIGS. 2, 3, 10, 11, 15, 19-21, 24, 26, and 27. Solid material silicone, which can be thicker silicone or silicone composition material, can run along the bottom edge of the protective swim cap in order to provide greater durability for repeated use and to provide a tighter seal on the swimmers head to prevent water leaking into the protective swim cap. For example, in one embodiment, the thickness of the protective swim cap can be about 0.0275 inches thick and the thickness of the bottom edge can be about 0.0475 inches thick.

Various embodiments are illustrated herein. FIGS. 1 through 23 illustrate embodiments of the disclosure that include the safety feature 102 and are of an anatomically correct shape. FIGS. 1 through 6 illustrate a first embodiment, FIGS. 7 and 8 illustrate a second embodiment that is similar to the first embodiment, but wherein the safety feature 102 has a dimpled outer surface, and FIGS. 9 through 23 illustrate a third embodiment that covers a similar amount of the head as the first and second embodiments, but wherein the depth of the solid free spaces 104 and open cells 106 and the diameter of the open cells 106 are smaller than that of the first embodiment and the tapered transition from the safety feature 102 on the top 204 of the protective swim cap to the sides 302 of the protective swim cap is different.

In a fourth embodiment, as illustrated in FIGS. 24 through 29, the protective swim cap does not have the safety feature 102 with open cells 106 and solid free space 104, but maintains the size, fit, and length of the various embodiments that contain the safety feature 102. The protective swim cap also maintains the anatomically correct shape, which enhances fit and function of the protective swim cap. In one embodiment, the protective swim cap without the safety feature 102 can be the same thickness as a standard swim cap. In another embodiment, the protective swim cap can maintain the thickness of the various embodiments that contain the safety feature 102 and, therefore, can offer greater protection than a standard swim cap. It can also include the improved shape and, therefore, fit and function.

The protective swim cap can be any number of sizes, some of which may specifically be used by swimmers with long hair. In one embodiment, the protective swim cap can have the following measurements: about 6.50 to 7.50 inches from front 202 to back 206; about 5.50 to 6.00 inches from side 302 to side 302; about 5.75 to 7.50 inches tall along the middle; about 6.50-7.50 inches tall at its longest extension in the back 206; and about 6.50 to 7.50 inches tall at its furthest external point.

In another embodiment, the protective swim cap can be of a smaller size with one embodiment being 7-10% smaller in all dimensions than that listed above. Its measurements can be as follows: about 5.80-6.75 inches from front 202 to back 206; 4.90-5.50 inch cross section from side 302 to side 302; 5.00-6.75 inches tall along the middle; 5.80-6.75 inches tall at its longest extension in the back 206; and 5.80-6.75 inches tall at its furthest external point.

In a further embodiment, the protective swim cap could be made of a material with higher density properties that maintains the other properties that allow full functionality of the protective swim cap as a swim cap to provide increased head protection, such as may be useful with small children or with physically at risk populations (such as those who have a histories of concussions, are developmentally challenged, etc.), therefore addressing the needs of athletes in the Special Olympics, Paralympic, or other groups like those. This could take the form of a low-profile helmet or use of more rigid material in the protective swim cap itself.

The protective swim cap could also be used for a variety of other aquatic activities such as, but not limited to, diving and scuba diving. Further, the protective swim cap could be used for non-aquatic activities such as, but not limited to, wrestling, rugby, other contact sports, or it could be used for individuals who are at risk of head injury due to lack of safe motor control (ex: individuals with epilepsy, muscular dystrophy, multiple sclerosis, etc.). The protective swim cap could be used as standalone protective headgear or it could be used as a supplemental piece of headgear.

The invention claimed is:

1. A protective swim cap comprising:

a flexible cap with a front, a top, a back, an exposed interior surface, and a bottom edge;

wherein:

the flexible cap includes a safety feature located in at least a portion of the top of the flexible cap, the safety feature is comprised of alternating solid material and open cells, and the open cells are pillar-shaped, and the open cells of the safety feature each have an aperture on the exposed interior surface of the protective swim cap.

2. The protective swim cap of claim 1, wherein the protective swim cap is configured to cover a wearer's ears.

3. The protective swim cap of claim 1, wherein the protective swim cap is tapered from front to back, with a front portion of the protective swim cap being shorter than a back portion of the protective swim cap.

4. The protective swim cap of claim 1, wherein at least a portion of the flexible cap proximate to the bottom edge is of greater thickness than the remaining portion of the flexible cap.

5. The protective swim cap of claim 1, wherein at least one portion of an external surface of the protective swim cap has a dimpled texture.

6. The protective swim cap of claim 1, wherein the open cells vary in diameter.

7. The protective swim cap of claim 1, wherein the alternating solid material and open cells are in a honeycomb structure.

8. The protective swim cap of claim 1, wherein the safety feature is removable.

9. The protective swim cap of claim 8, wherein the safety feature connects to the protective swim cap via a pocket.

10. The protective swim cap of claim 1, wherein an external surface of the swim cap is smooth.

11. The protective swim cap of claim 1, wherein the open cells vary in depth.

12. The protective swim cap of claim 11, wherein at least a portion of the open cells proximate to the top of the flexible cap have greater depth than at least a portion of the open cells near at least one of the front or the back of the flexible cap.

13. The protective swim cap of claim 1, wherein the safety feature extends from the top of the flexible cap to at least one of the front or the back of the flexible cap.

14. The protective swim cap of claim 13, wherein:

the safety feature further extends from the top of the flexible cap and down a first side of the flexible cap to a wearer's first ear, and the safety feature further extends from the top of the flexible cap and down a second side of the flexible cap to a wearer's second ear.

15. The protective swim cap of claim 14, wherein the safety feature extends from the top of the flexible cap to cover the entire flexible cap.

16. A protective cap comprising:

a cap with a front, a top, a back, an exposed interior surface, and a bottom edge; and a safety feature located on the front, the top, and the back of the cap;

wherein:

the safety feature is comprised of a layer of alternating solid material and open cells that are in a honeycomb structure; and the open cells each have an aperture on the exposed interior surface of the protective cap.

17. The protective cap of claim 16, wherein the protective cap is tapered from front to back, with a front portion of the protective cap being shorter than a back portion of the protective cap.

18. The protective cap of claim 16, wherein the open cells vary in diameter.

19. The protective cap of claim 16, wherein the open cells vary in depth.

20. The protective cap of claim 19, wherein at least a portion of the open cells proximate to the top of the cap have greater depth than at least a portion of the open cells near at least one of the front or the back of the cap.

21. The protective cap of claim 16, wherein the safety feature is removable.

22. A wearable safety device to cushion against impact or collision, the safety device comprised of:

an outer surface;

an inner surface positioned to face a user's body when the wearable safety device is being worn;

a layer of open pillar-shaped cells below the outer surface;

solid material between the plurality of open, pillar-shaped cells; and a solid layer between the plurality of open, pillar-shaped cells and the outer surface;

wherein:

the solid material and the plurality of open, pillar-shaped cells are alternating and arranged in a honeycomb structure;

the open, pillar-shaped cells each have an aperture on the inner surface; and at least a portion of the safety device is flexible.

23. The wearable safety device of claim 22, wherein the wearable safety device is a protective swim cap.

24. The wearable safety device of claim 22, wherein the wearable safety device is located between two layers of fabric.

* * * * *